US005865219A

United States Patent [19]

Lee et al.

[11] Patent Number: 5,865,219

[45] Date of Patent: Feb. 2, 1999

[54] DOUBLE LAYER PAPERMAKING FABRIC HAVING A HIGH STABILITY WEAVE

[75] Inventors: Henry J. Lee, Summerville; T. Payton Crosby, Walterboro, both of S.C.

[73] Assignee: Asten, Inc., Charleston, S.C.

[21] Appl. No.: 904,482

[22] Filed: Jul. 31, 1997

[51] Int. Cl.[6] ..... D03D 11/00; D03D 13/00

[52] U.S. Cl. ..... 139/383 A; 442/207; 442/247; 139/413; 139/383 AA

[58] Field of Search ..... 442/207, 247; 139/383 A, 38 AA, 413, 414

[56] References Cited

U.S. PATENT DOCUMENTS

| | | | |
|---|---|---|---|
| 653,595 | 7/1900 | Stevenson . | |
| 2,741,824 | 4/1956 | Robbins, II et al. . | |
| 4,041,989 | 8/1977 | Johansson et al. . | |
| 4,071,050 | 1/1978 | Codorniu . | |
| 4,286,631 | 9/1981 | Strandly . | |
| 4,592,395 | 6/1986 | Borel . | |
| 4,998,568 | 3/1991 | Vohringer | 139/383 A |
| 5,025,839 | 6/1991 | Wright . | |
| 5,101,866 | 4/1992 | Quigley . | |
| 5,152,326 | 10/1992 | Vohringer | 139/383 A |
| 5,564,475 | 10/1996 | Wright | 139/383 A |

FOREIGN PATENT DOCUMENTS

| | | |
|---|---|---|
| 7702520 | 11/1978 | Switzerland . |

*Primary Examiner*—Andy Falik
*Attorney, Agent, or Firm*—Volpe and Koenig, P.C.

[57] ABSTRACT

A double layer papermaking fabric having first and second layers of cross machine direction (CMD) yarns interwoven with a system of machine direction (MD) yarns. The MD repeat pattern is characterized by a portion that weaves exclusively with the first CMD layer, a portion that transitions between the layers, a portion that weaves exclusively with the second CMD layer and a portion that transitions between the layers.

16 Claims, 13 Drawing Sheets

DOUBLE LAYER PAPERMAKING FABRIC HAVING A HIGH STABILITY WEAVE

BACKGROUND OF THE INVENTION

1. Field of the Invention

The present invention generally relates to a woven fabric which is designed for use in a papermaking, cellulose or board manufacturing machine and more particularly to a double layer papermaking fabric.

2. Description of the Prior Art

Woven fabrics of single and double layer constructions are used in the various sections of a papermaking, cellulose, board or other similar machine. Frequently, double layer fabrics have two layers of cross machine direction (CMD) yarns which are interconnected by a system of machine direction (MD) yarns. One type of double layer fabric which is useful in a dryer section is shown in FIG. 1. This fabric is characterized by a weave in which each MD yarn in succession binds between a first pair of CMD yarns, above a second pair, between a third pair and beneath a fourth pair before the procedure is repeated. This MD weave pattern generally produces a yarn having a diagonal section that passes between CMD layers and is often referred to as an "N" weave.

The structure of standard double layer fabrics results in fabrics which are less stable in the MD since the MD yarns weave into the construction with fewer interlacings of the CMD yarns and provide little crimp interchange between the MD and CMD yarns. As a result, the double layer fabric's ability to withstand distortion during use is decreased. A common method of enhancing fabric stability is the addition of post weaving treatments or resins. However, these processes are generally messy, time consuming and expensive.

Accordingly, there is a need for a double layer papermaking fabric which provides greater stability without requiring finishing processes to achieve such stability.

SUMMARY OF THE INVENTION

The present invention provides a double layer papermaking fabric having a system of machine direction MD yarns interwoven with two layers of CMD yarns. The MD yarn weave pattern includes a portion that weaves exclusively with the CMD first layer and a portion that weaves exclusively with the CMD second layer. Each exclusive MD weave portion weaves with at least three CMD yarns and interlaces with at least one of the CMD yarns in that layer. The MD yarn weave repeat also includes portions which extend between the exclusive weave portions and transition between the two CMD layers.

DESCRIPTION OF THE PREFERRED EMBODIMENTS

Figure 1:
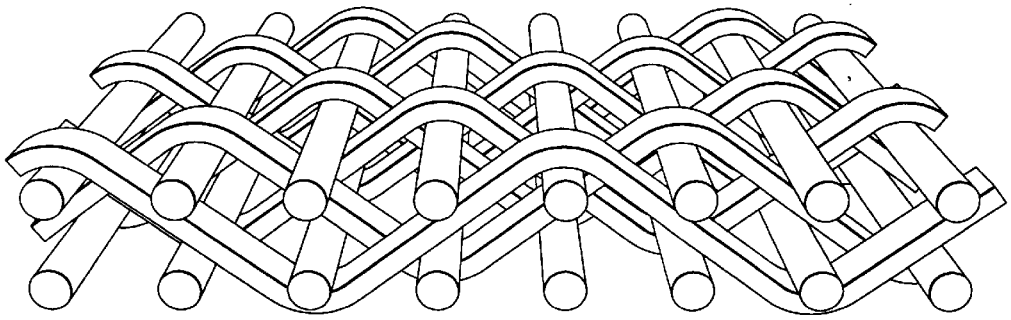
FIG. 1 (PRIOR ART)
FIG. 1 is a perspective view of a prior art double layer fabric.
Figure 2:
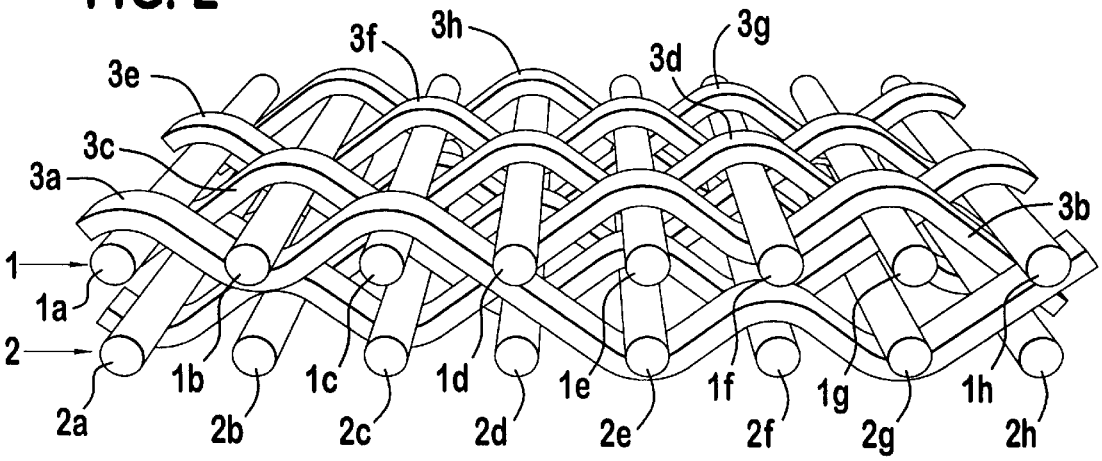
FIG. 2 is a perspective view of a fabric according to the present invention.
Figure 3:
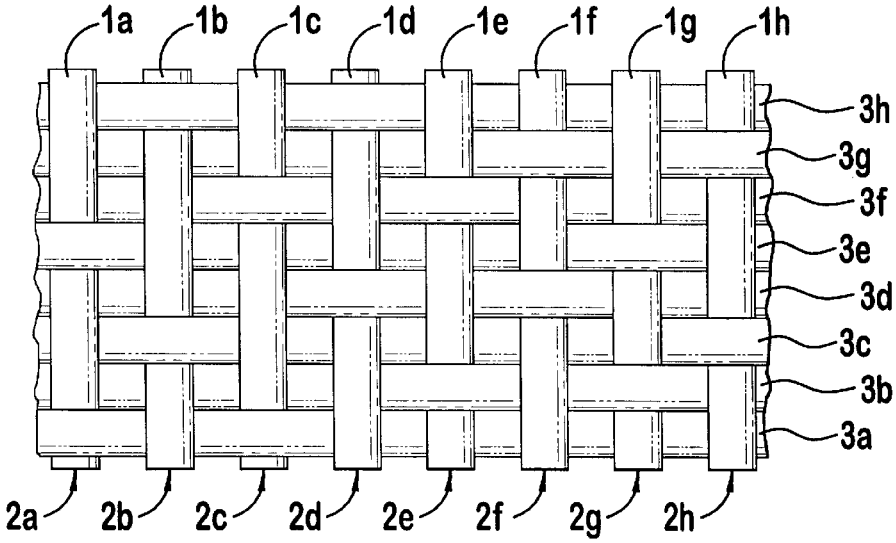
FIG. 3 is a top plan view of the fabric of FIG. 2.
Figure 4:
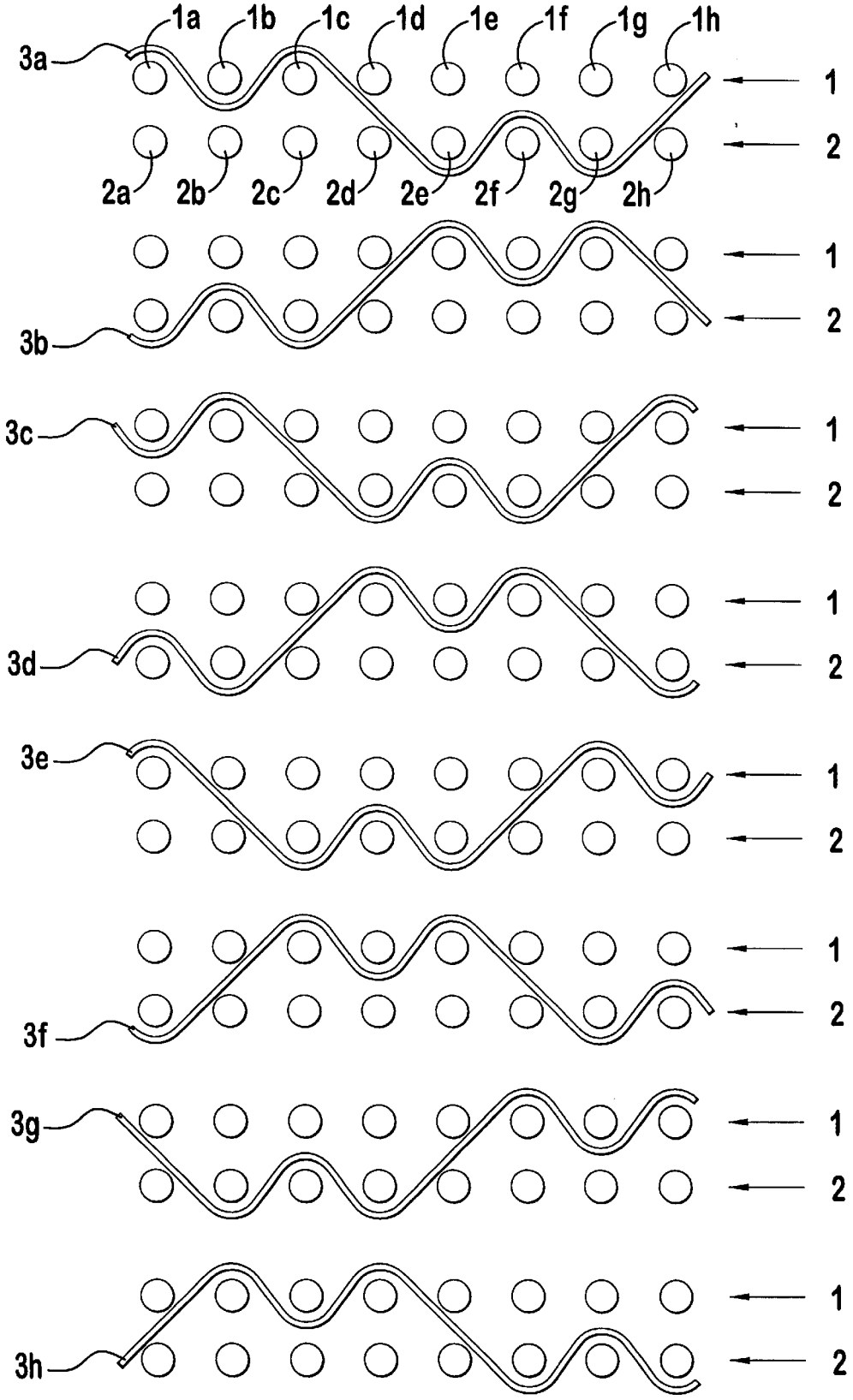
FIG. 4 shows the side elevation of each MD yarn in a given repeat of the fabric of FIG. 2.

In the embodiment of FIGS. 2 to 4, MD yarns 3 interweave with two CMD layers 1 and 2. Each yarn of upper CMD layer 1 is paired with a yarn of lower CMD layer 2. In a given repeat, each MD yarn 3 weaves in a plain weave in CMD layer 1, transitions between the layers using a diagonal pass similar to that used in an "N" weave, weaves in a plain weave in CMD layer 2, and transitions between the layers. The preferred weave repeats on eight MD yarns. The repeat of each of the MD yarns 3*a*–3*h* is illustrated in FIG. 4.

MD yarn 3*a* weaves over the first pair, between the second pair, over the third pair, between the fourth pair, under the fifth pair, between the sixth pair, under the seventh pair, and between the eighth pair of CMD yarns before the pattern is repeated.

MD yarn 3*b* weaves under the first pair, between the second pair, under the third pair, between the fourth pair, over the fifth pair, between the sixth pair, over the seventh pair, and between the eighth pair of CMD yarns before the pattern is repeated.

MD yarn 3*c* weaves between the first pair, over the second pair, between the third pair, under the fourth pair, between the fifth pair, under the sixth pair, between the seventh pair, and over the eighth pair of CMD yarns before the pattern is repeated.

MD yarn 3*d* weaves between the first pair, under the second pair, between the third pair, over the fourth pair, between the fifth pair, over the sixth pair, between the seventh pair, and under the eighth pair of CMD yarns before the pattern is repeated.

MD yarn 3*e* weaves over the first pair, between the second pair, under the third pair, between the fourth pair, under the fifth pair, between the sixth pair, over the seventh pair, and between the eighth pair of CMD yarns before the pattern is repeated.

MD yarn 3*f* weaves under the first pair, between the second pair, over the third pair, between the fourth pair, over the fifth pair, between the sixth pair, under the seventh pair, and between the eighth pair of CMD yarns before the pattern is repeated.

MD yarn 3*g* weaves between the first pair, under the second pair, between the third pair, under the fourth pair, between the fifth pair, over the sixth pair, between the seventh pair, and over the eighth pair of CMD yarns before the pattern is repeated.

MD yarn 3*h* weaves between the first pair, over the second pair, between the third pair, over the fourth pair, between the fifth pair, under the sixth pair, between the seventh pair, and under the eighth pair of CMD yarns before the pattern is repeated.

The diagonal passes of adjacent MD yarns in the fabric as described herein crisscross each other. For example, adjacent MD yarns 3*a* and 3*b* both transition between the fourth pair of CMD yarns. However, the diagonal passes of adjacent MD yarns 3 do not have to crisscross, but instead may be spaced from one another.

The MD plain weave in CMD layers 1 and 2 provides machine direction stability to the fabric since the MD yarns interlace with, and thereby crimp and hold, the CMD yarns. Although it is preferred to use a plain weave, the MD weave pattern in a given layer can be any weave pattern which crimps at least two of the CMD yarns in that section of repeat.

As can be seen from FIG. 3, the MD yarns 3 remain in substantially a vertical plane extending in the machine direction. Respective CMD yarn pairs 1 and 2 remain in substantially a vertical plane extending in the cross machine direction.

Figure 5:
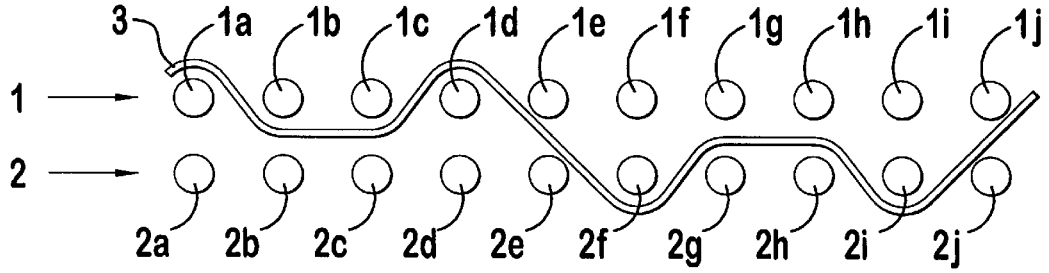
FIG. 5 shows the MD weave pattern of a second embodiment of the present invention.
Figure 6:
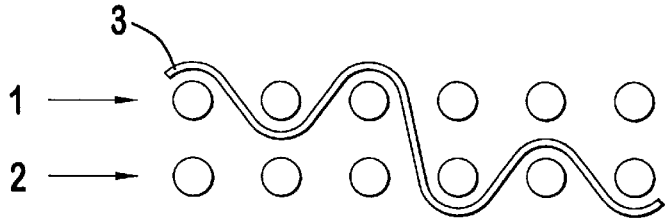
FIG. 6 shows the MD weave pattern of a third embodiment of the fabric of the present invention.

An example of an alternate MD weave pattern is shown in FIG. 5. As can be seen therein, the MD yarn 3 crimps CMD yarns 1*a* and 1*d* in the first layer portion of the repeat and CMD yarns 2*f* and 2*i* in the second layer portion of the repeat. The MD weave pattern in each layer can be independent of the other layer. Additionally, the weave patterns of the transitions can also be varied, an example of which is shown in FIG. 6. The weave patterns may also be varied by varying the number of yarns upon which the fabric repeats. For example, the weave pattern shown in FIG. 6 repeats on six CMD yarns and six MD yarns.

Figure 7:
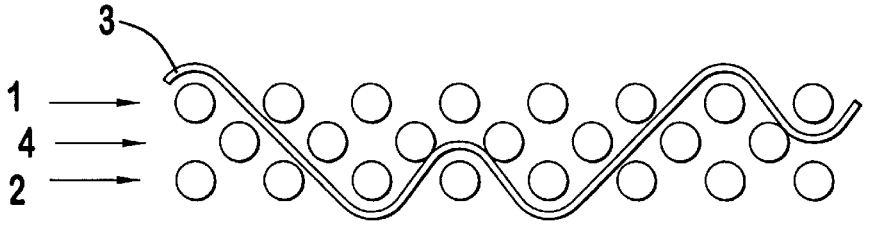
FIG. 7 shows the MD weave pattern of a fourth embodiment of the fabric of the present invention.
Figure 8:
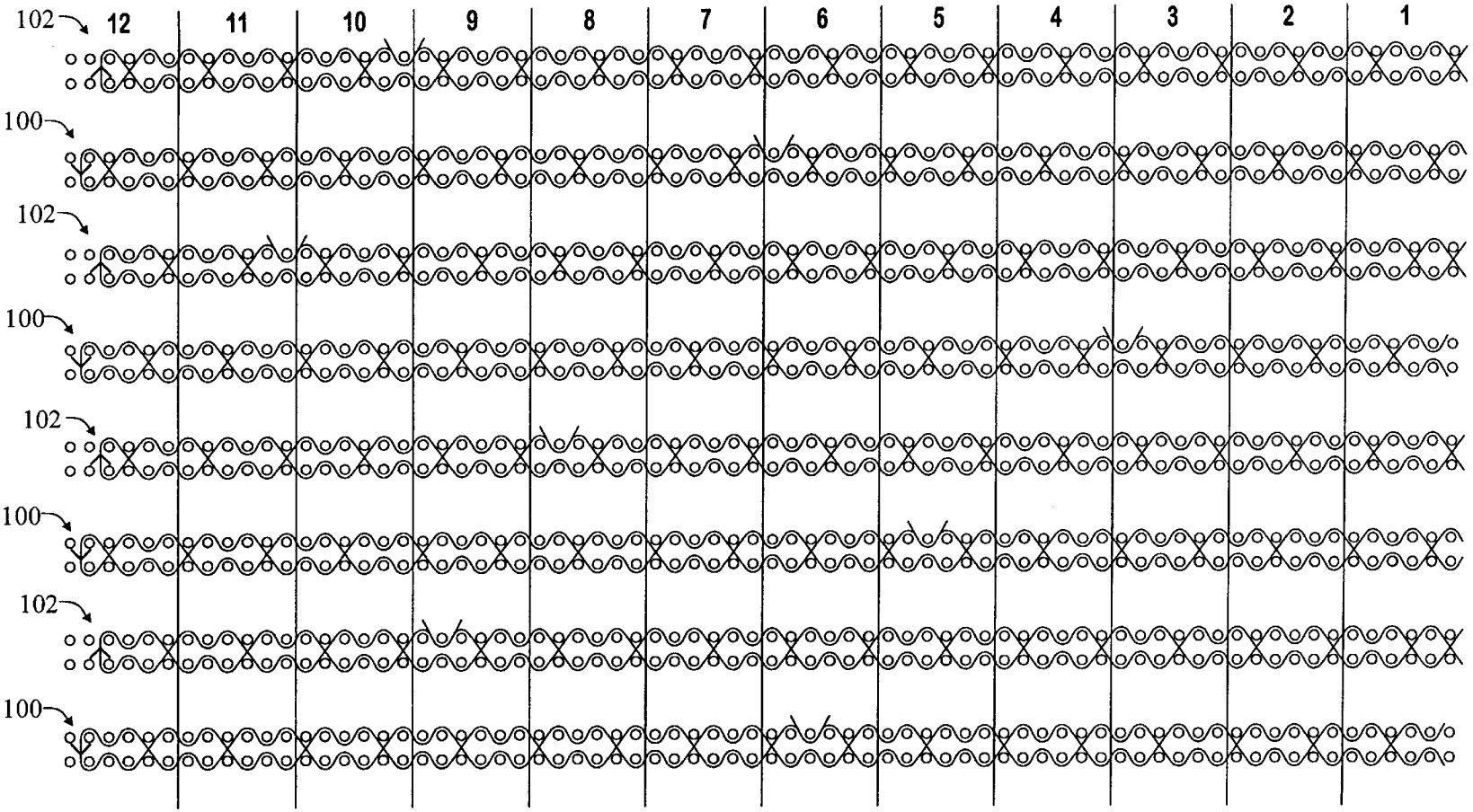
FIGS. 8 and 9 show the preferred pattern for seaming a first end of the fabric.
Figure 9A:
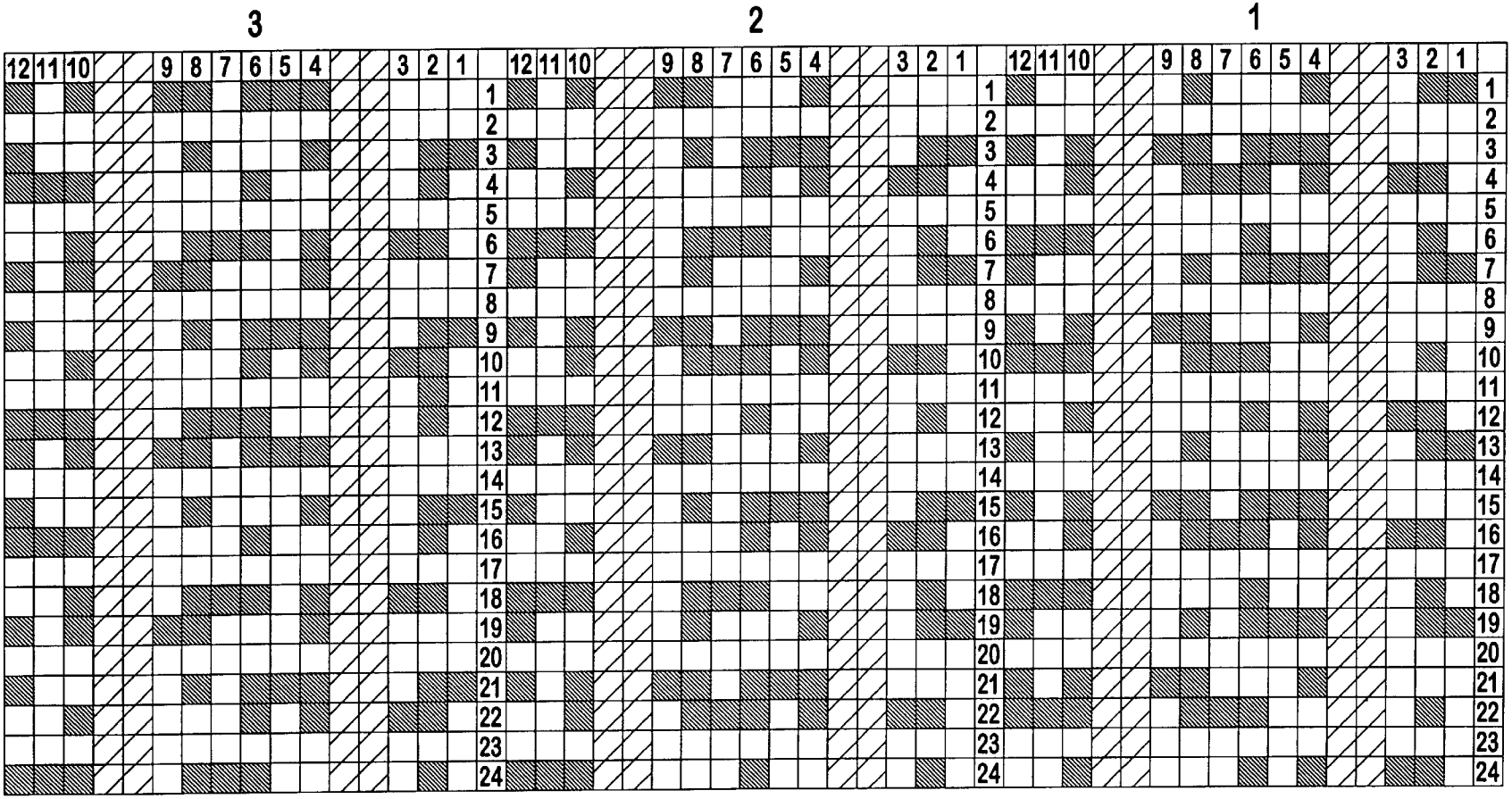
Figure 9B:
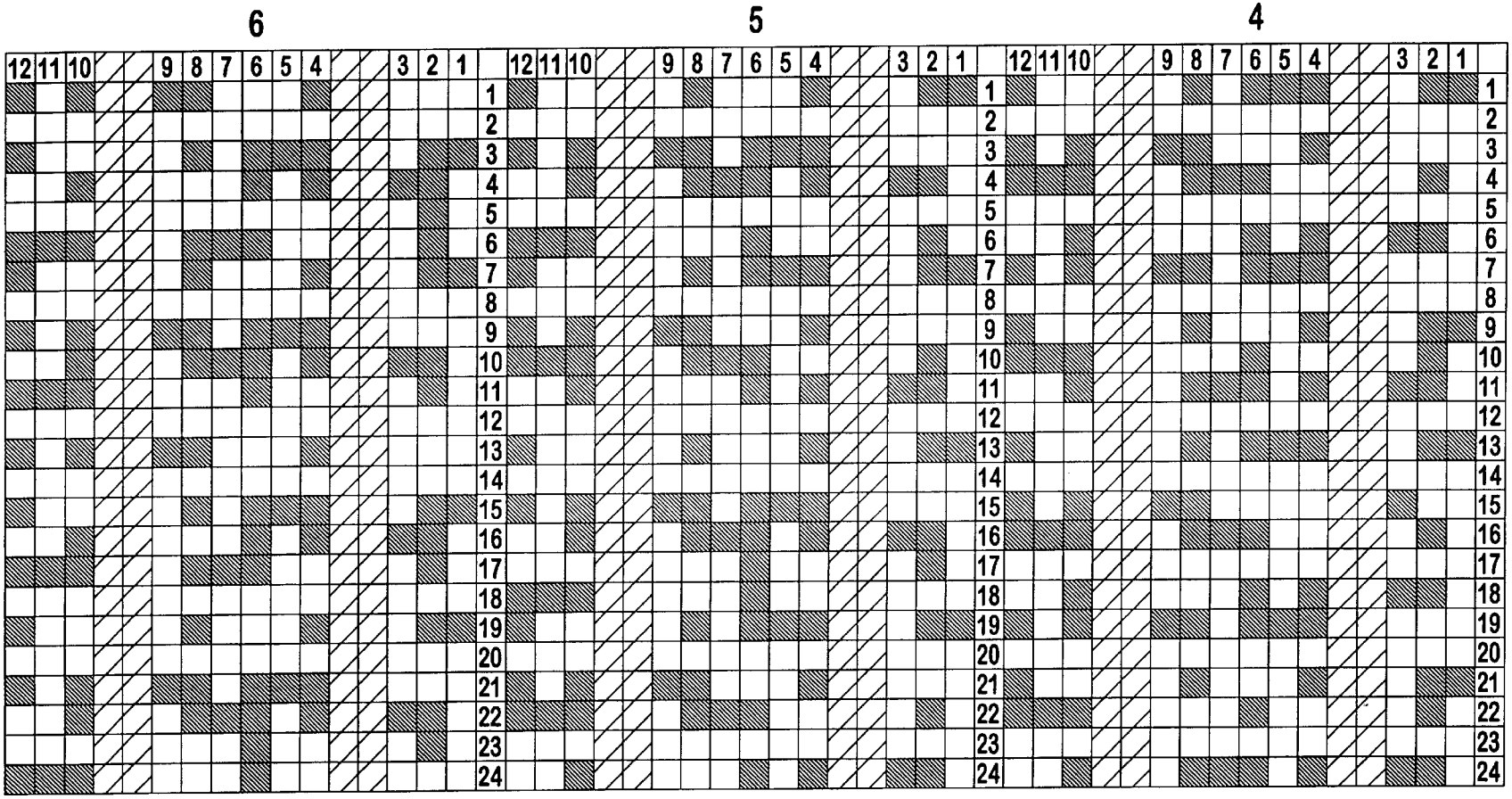
Figure 9C:
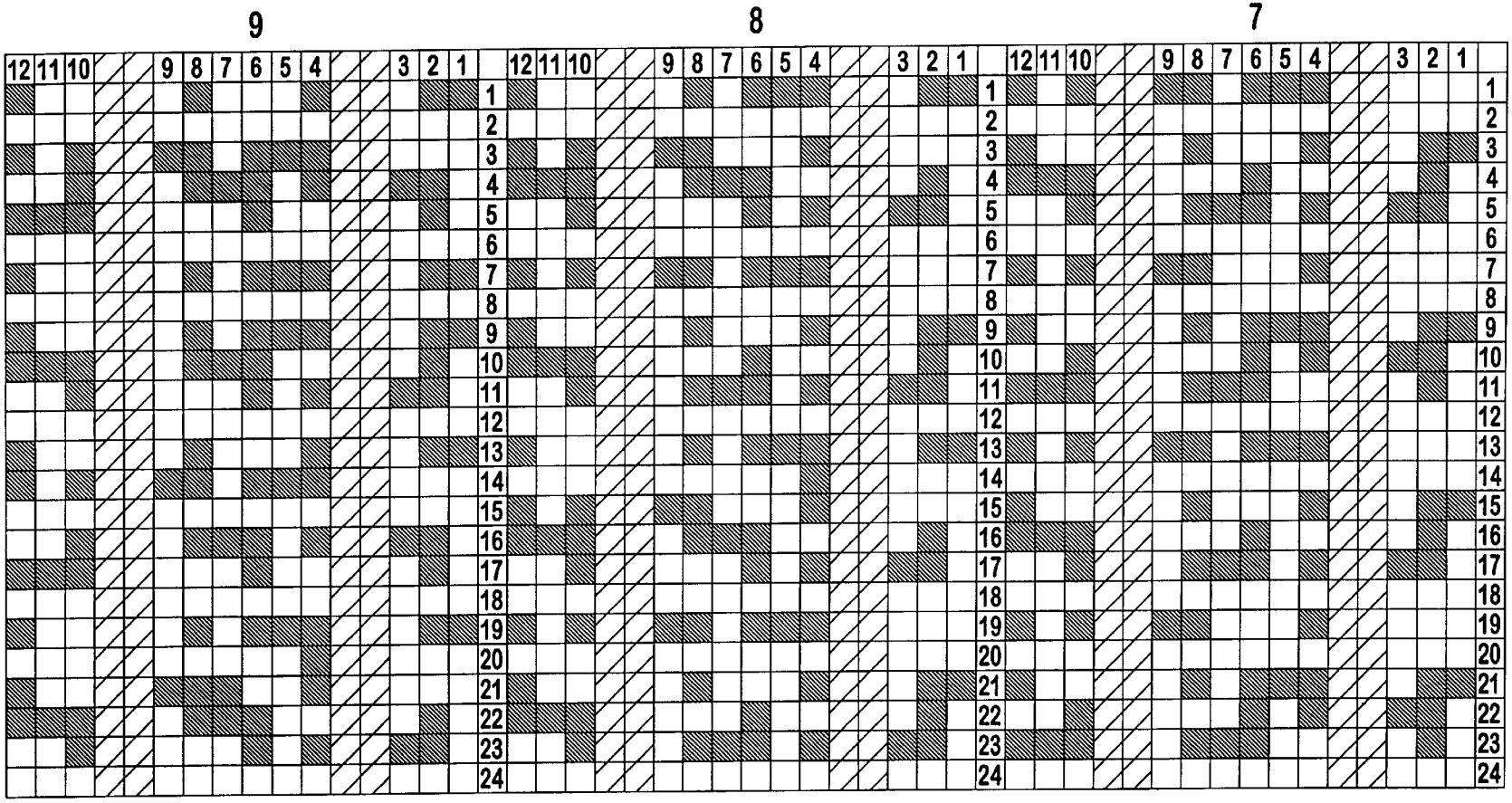
Figure 9D:
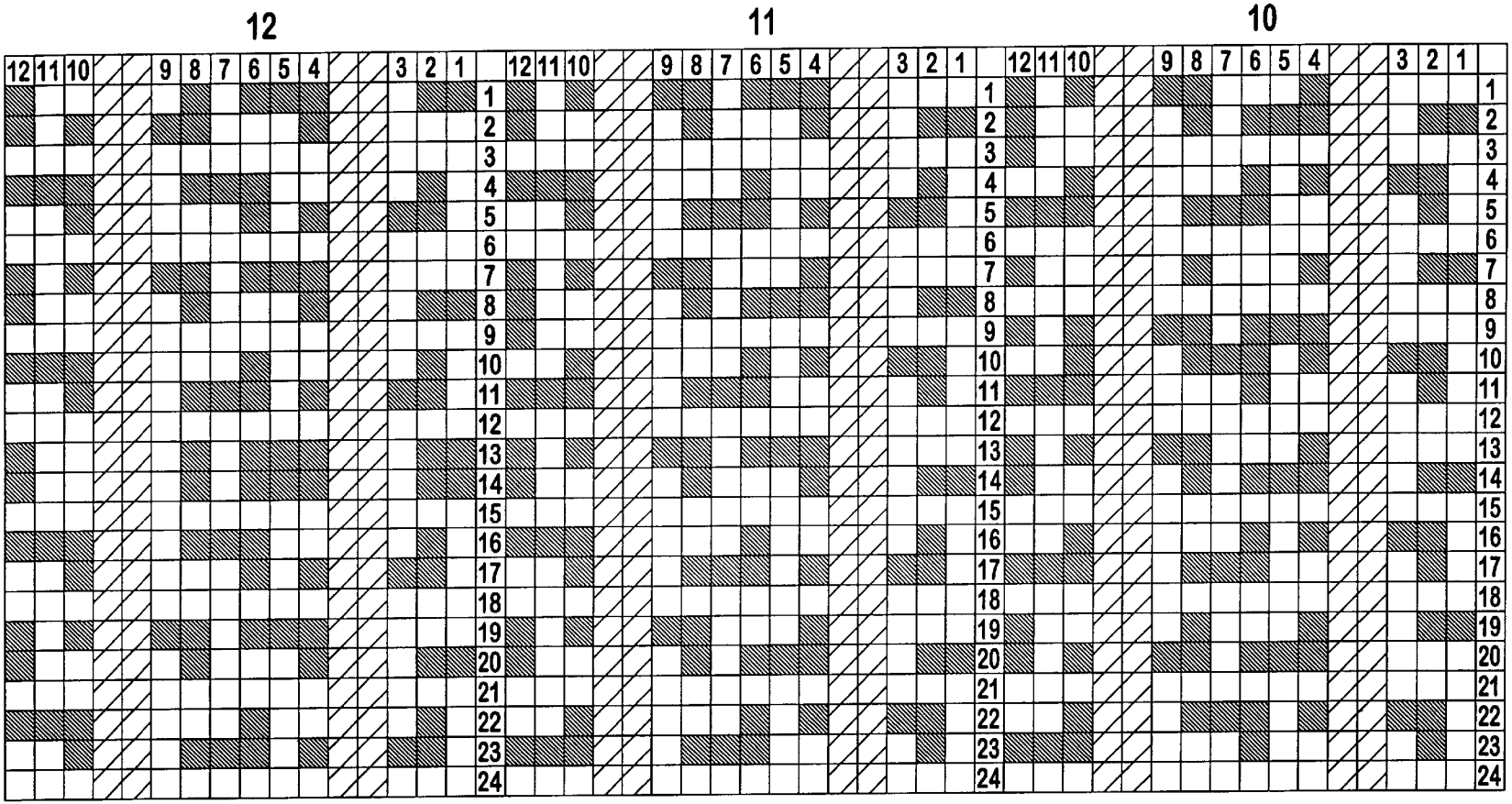
Figure 10:
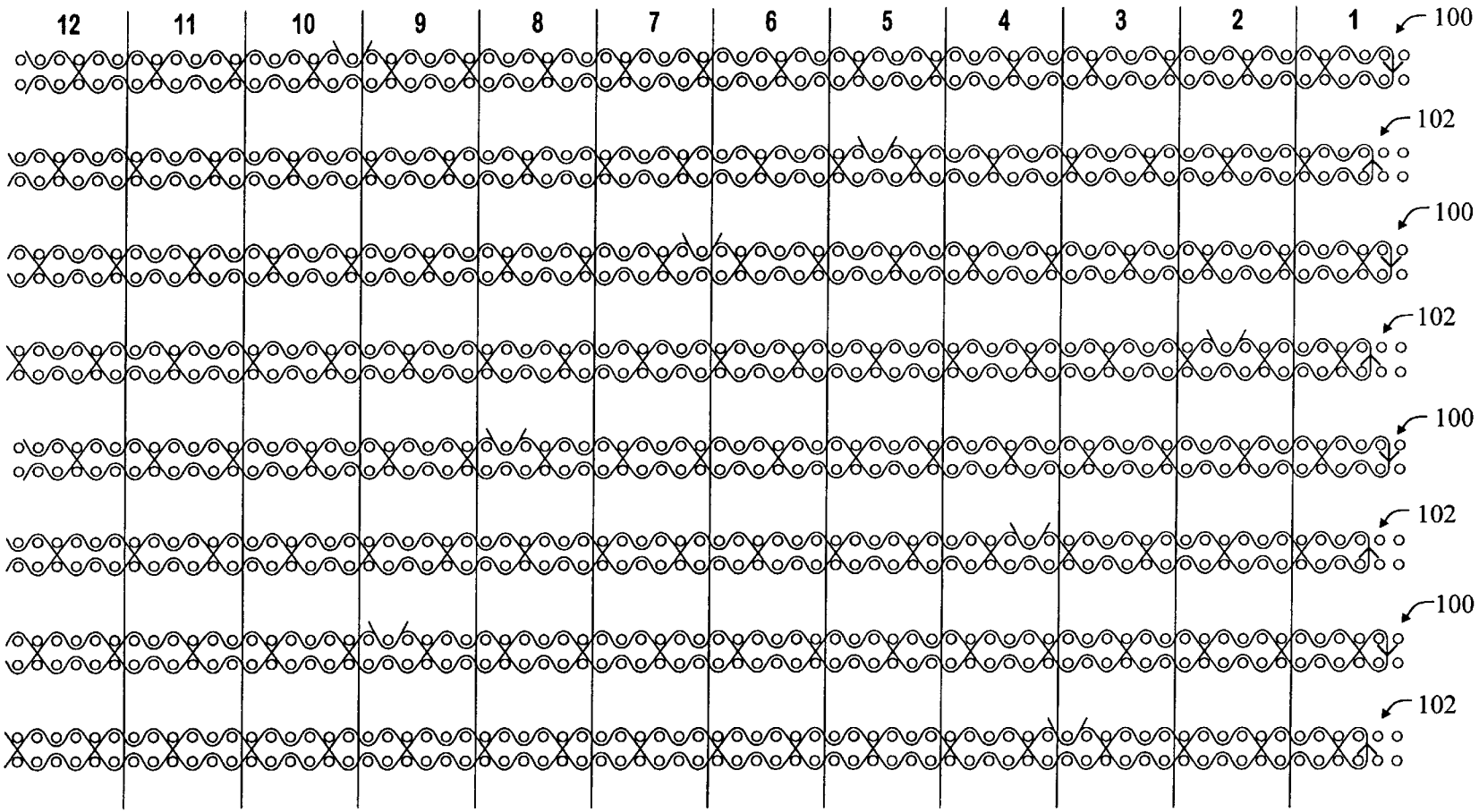
FIGS. 10 and 11 show the preferred pattern for seaming a second end of the fabric.
Figure 11A:
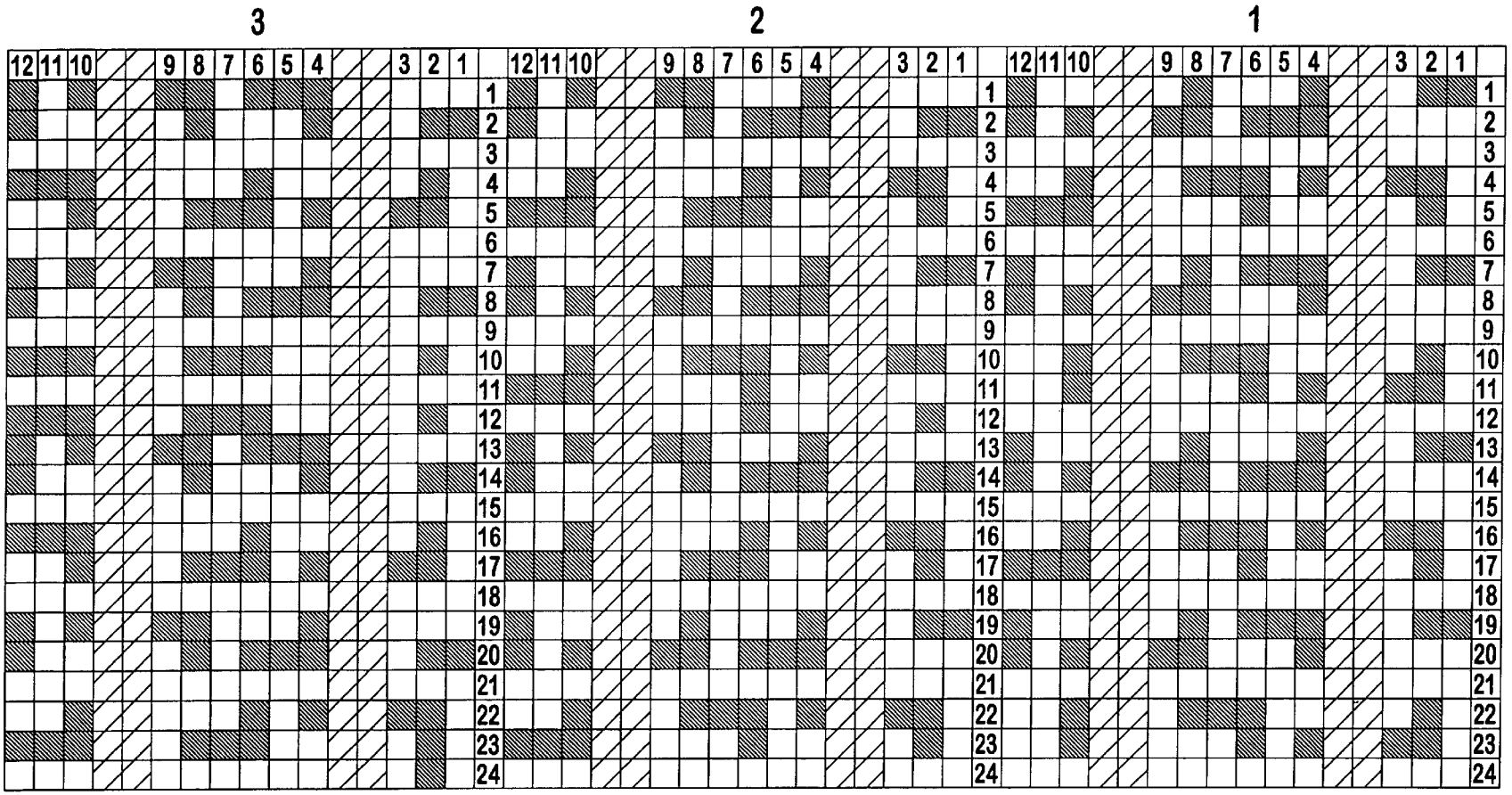
Figure 11B:
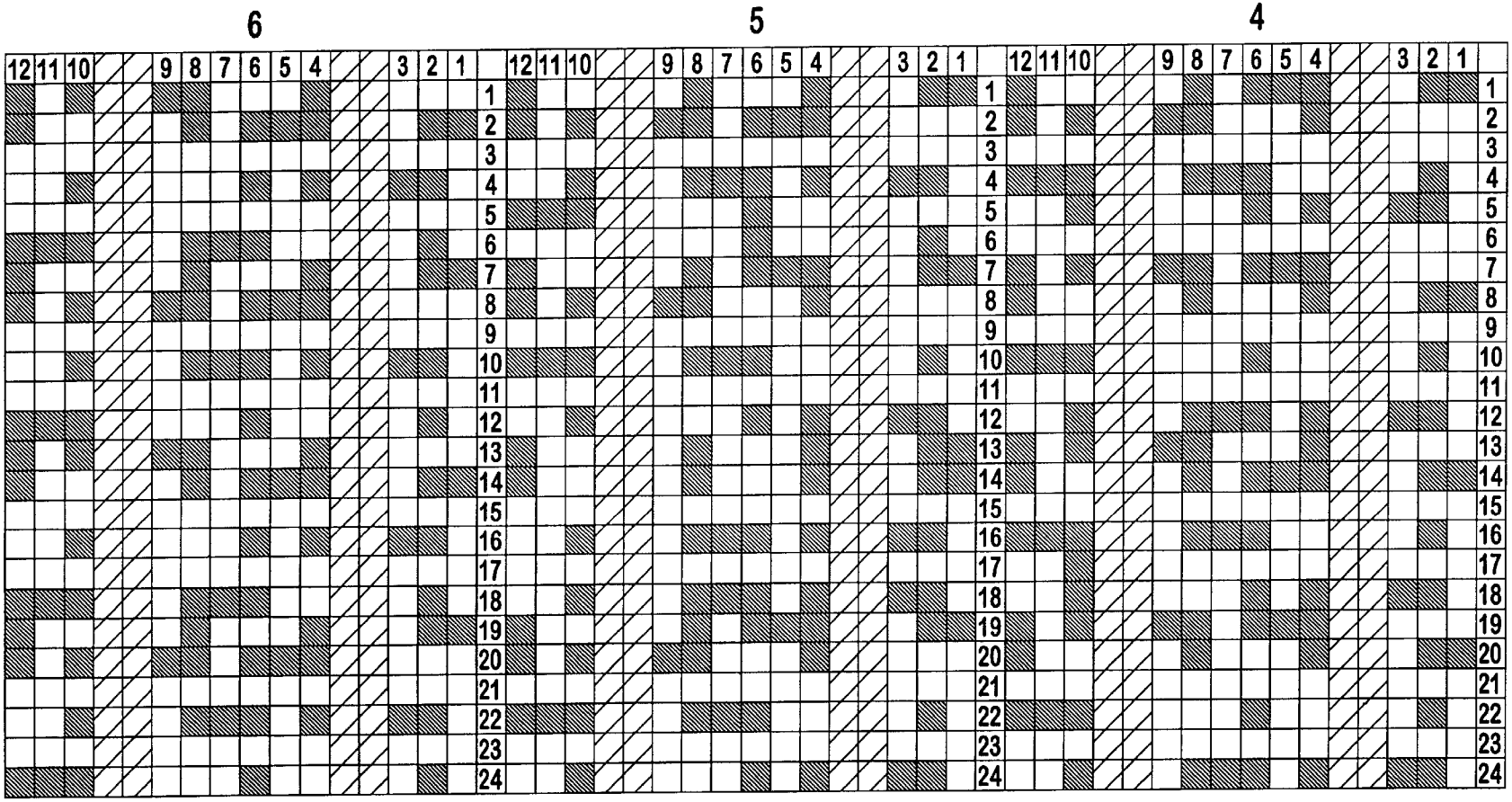
Figure 11C:
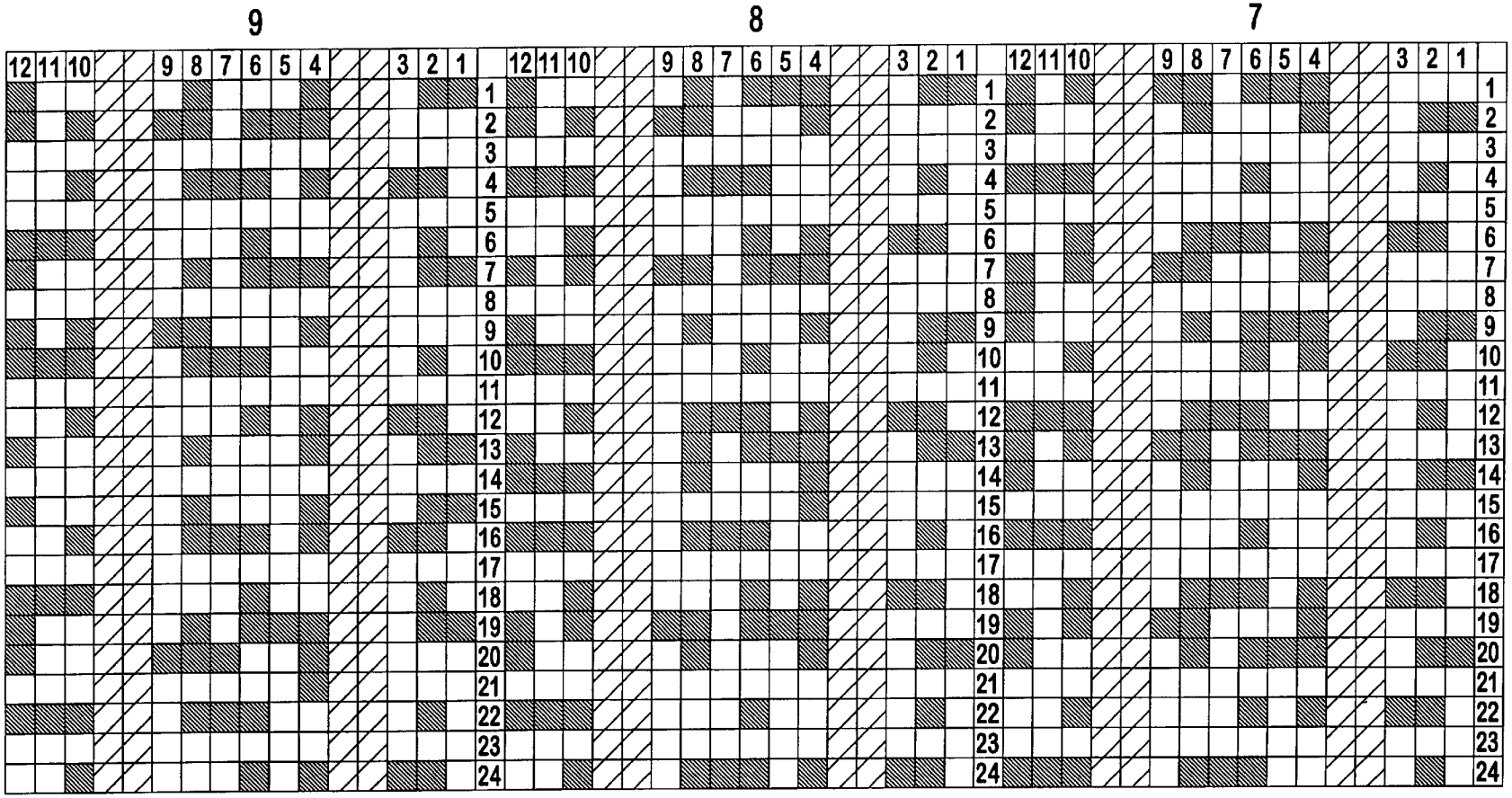
Figure 11D:
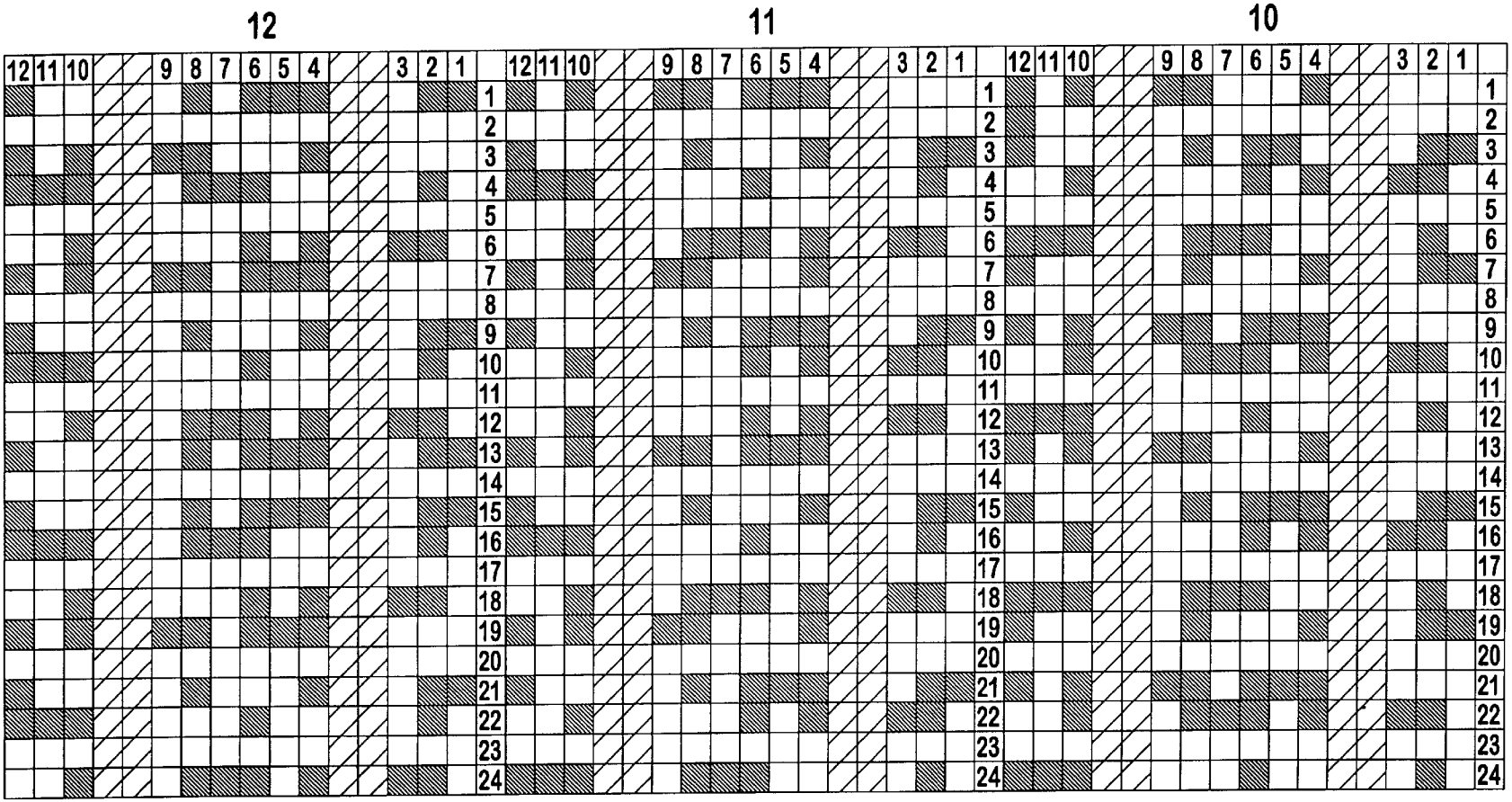

The permeability of the fabric may be adjusted by inserting stuffer yarns 4 in the fabric. As shown in FIG. 7, the stuffer yarns 4 are preferably inserted between each pair of CMD yarns 1 and 2. If desired, a layer of batt material 10, see FIG. 2, may be applied to one or both sides of the fabric.

If the fabric is flat woven, it is preferably seamed with uniform loops 100 and tiebacks 102. Since the preferred fabric repeats on eight MD yarns, the seam patterns for standard "N" weave fabrics generally do not provide even length seam loops or tiebacks in the eight MD yarns. Therefore, it is preferred to utilize seam patterns for the individual seam loops 100 and tiebacks 102 that provides even seam loops 100 and tiebacks 102 on each seam forming end. Exemplary seam patterns that provide even seam loops 100 and tiebacks 102 are shown in FIGS. 8–11.

We claim:

1. A double layer papermaking fabric of a type having a first layer of cross machine direction (CMD) yarns, a second layer of CMD yarns, and a system of machine direction (MD) yarns interwoven with the CMD yarn layers, wherein the fabric repeats on eight CMD yarns and selected MD yarns weave in a pattern characterized by:

a portion that weaves exclusively with the CMD first layer for at least three CMD yarns and has at least one interlacing;

a portion that transitions between the layers;

a portion that weaves exclusively with the CMD second layer for at least three CMD yarns and has at least one interlacing; and a portion that transitions between the layers; and all portions of the selected MD yarns lying in substantially the same vertical plane extending in the machine direction.

2. The fabric of claim 1 wherein the first layer MD weave portion weaves in a plain weave.

3. The fabric of claim 1 wherein the second layer MD weave portion weaves in a plain weave.

4. The fabric of claim 1 wherein the first and second layer weave portions have the same weave pattern.

5. The fabric of claim 1 wherein each first layer CMD yarn is paired with a second layer CMD yarn.

6. The fabric of claim 5 wherein each MD transition portion passes between at least one pair of first and second CMD yarns.

7. The fabric of claim 5 wherein each MD yarn weaves over a first pair, between a second pair, over a third pair, between a fourth pair, under a fifth pair, between a sixth pair, under a seventh pair, and between an eighth pair of CMD yarns in a given repeat.

8. The fabric of claim 1 further comprising stuffer yarns between the CMD layers.

9. The fabric of claim 1 further comprising batt material attached thereto.

10. A double layer papermaking fabric of a type having a first layer of cross machine direction (CMD) yarns, a second layer of CMD yarns, and a system of machine direction (MD) yarns interwoven with the CMD yarn layers, wherein the fabric repeats on six CMD yarns and selected MD yarns weave in a pattern characterized by:

a portion that weaves exclusively with the CMD first layer for at least three CMD yarns and has at least one interlacing;

a portion that transitions between the layers;

a portion that weaves exclusively with the CMD second layer for at least three CMD yarns and has at least one interlacing; and a portion that transitions between the layers; and all portions of the selected MD yarns lying in substantially the same vertical plane extending in the machine direction.

11. The fabric of claim 10 wherein each first layer CMD yarn is paired with a second layer CMD yarn.

12. The fabric of claim 11 wherein each MD transition portion weaves in a plain weave between adjacent pairs of first and second layer CMD yarns.

13. The fabric of claim 11 wherein each MD yarn weaves over a first pair, between a second pair, over a third pair, under a fourth pair, between a fifth pair, and under a sixth pair of CMD yarns in a given repeat.

14. A double layer papermaking fabric of a type having a first layer of cross machine direction (CMD) yarns, a second layer of CMD yarns, and a system of machine direction (MD) yarns interwoven with the CMD yarn layers, wherein the fabric repeats on eight MD yarns and selected MD yarns weave in a pattern characterized by:

a portion that weaves exclusively with the CMD first layer for at least three CMD yarns and has at least one interlacing;

a portion that transitions between the layers;

a portion that weaves exclusively with the CMD second layer for at least three CMD yarns and has at least one interlacing; and a portion that transitions between the layers; and all portions of the selected MD yarns lying in substantially the same vertical plane extending in the machine direction.

15. A double layer papermaking fabric of a type having a first layer of cross machine direction (CMD) yarns, a second layer of CMD yarns, and a system of machine direction (MD) yarns interwoven with the CMD yarn layers, wherein the fabric repeats on six MD yarns and selected MD yarns weave in a pattern characterized by:

a portion that weaves exclusively with the CMD first layer for at least three CMD yarns and has at least one interlacing;

a portion that transitions between the layers;

a portion that weaves exclusively with the CMD second layer for at least three CMD yarns and has at least one interlacing; and a portion that transitions between the layers; and all portions of the selected MD yarns lying in substantially the same vertical plane extending in the machine direction.

16. A double layer, open ended papermaking fabric of a type having a first layer of cross machine direction (CMD) yarns, a second layer of CMD yarns, and a system of machine direction (MD) yarns interwoven with the CMD yarn layers and is rendered endless by a seam, wherein the fabric is characterized by:

selected MD yarns woven in a pattern having:

a portion that weaves exclusively with the CMD first layer for at least three CMD yarns and has at least one interlacing;

a portion that transitions between the layers;

a portion that weaves exclusively with the CMD second layer for at least three CMD yarns and has at least one interlacing;

a portion that transitions between the layers; and all portions of the selected MD yarns lie in substantially the same vertical plane extending in the machine direction; and each fabric end has even loops and tiebacks.

* * * * *